US005863225A

United States Patent [19]

Liebich et al.

[11] Patent Number: 5,863,225

[45] Date of Patent: Jan. 26, 1999

[54] CONTACT WITH A BOTTOM AND A TOP SPRING

[75] Inventors: Ernst Liebich, Geltendorf; Richard Flieger, Stammham, both of Germany

[73] Assignee: Siemens Aktiengesellschaft, Munich, Germany

[21] Appl. No.: 723,977

[22] Filed: Sep. 30, 1996

[30] Foreign Application Priority Data

Sep. 29, 1995 [DE] Germany ..... 195 36 500.3

[51] Int. Cl.[6] ..... H01R 13/18

[52] U.S. Cl. ..... 439/845

[58] Field of Search ..... 439/843–847, 439/752.5, 839

[56] References Cited

U.S. PATENT DOCUMENTS

| | | | |
|---|---|---|---|
| 5,240,439 | 8/1993 | Egenolf | 439/839 |
| 5,281,175 | 1/1994 | Chupak et al. | 439/839 |
| 5,433,629 | 7/1995 | Yagi et al. | 439/845 |
| 5,573,434 | 11/1996 | Ittah et al. | 439/839 |
| 5,624,273 | 4/1997 | Myer | 439/752.5 |

FOREIGN PATENT DOCUMENTS

| | | |
|---|---|---|
| 9201047.4 | 7/1993 | Germany . |
| 4312641A1 | 10/1994 | Germany . |

*Primary Examiner*—Gary F. Pauman
*Attorney, Agent, or Firm*—Herbert L. Lerner; Laurence A. Greenberg

[57] ABSTRACT

A top spring of a bush contact encloses a base spring like an enclosing box. The top spring is a stamped and bent part with a production-dictated longitudinal slit in the top wall (extending in a plug-in direction). To form a stable, closed box form of the top spring, the slit top wall parts are provided with a connecting tab, respectively at either end of the longitudinal slit. The connecting tab is joined to the respectively opposite top wall part by form lock and/or by force lock.

20 Claims, 2 Drawing Sheets

CONTACT WITH A BOTTOM AND A TOP SPRING

BACKGROUND OF THE INVENTION

1. Field of the Invention

The invention relates to a contact with a base spring. The base spring has a connecting part for an electrical conductor and a contact part with a spring leg base and spring legs, originating at this base, for contacting a plug contact, and having a top spring enclosing the contact part of the base spring in boxlike fashion, made of sheet metal from a stamped and bent part, which top spring has a bottom wall, two side walls, and a top wall split by a production-dictated longitudinal slit, and on two opposed walls, is embodied with cut-out, inward-bent top spring tongues resting on the spring legs of the base spring, and having a detent hook cut out of a wall and bent outward, extending longitudinally of the top spring, and is also embodied with a polarizing element.

2. Description of the Related Art

A contact of the above-described kind is known for instance from German Utility Model DE 92 02366 U.

For electrical plug connections, contact springs are used that are embodied as a contact and comprise a base spring and a top spring that, among other purposes to reinforce the contact force for the base spring, surrounds the base spring in boxlike fashion. The top spring moreover usually has still further functions and is intended for instance—as in the known contact—to effect a primary securing and polarization of a contact that can be inserted into a contact chamber of a contact carrier. To that end, the top spring is embodied on one side with a cut-out, outward-bent detent spring arm for primary securing, and also on the same side or on a different side with a likewise outward-bent tablike plate for polarization purposes. In addition, the top spring must still be secured to the base spring in a suitable way. In such contacts, both the base spring and the top spring are made of a sheet-metal stamped and bent part. Because of a resultant production-dictated longitudinal slit on one side, the stability of the box shape of the top spring can be impaired—especially in the case of top springs with additional functions.

SUMMARY OF THE INVENTION

It is accordingly an object of the invention to provide a contact with bottom and top spring, which overcomes the above-mentioned disadvantages of the heretofore-known devices and methods of this general type and which attains the best possible stable box shape of the top spring.

With the foregoing and other objects in view there is provided, in accordance with the invention, a contact, comprising:

a base spring with a connecting part for an electrical conductor and a contact part with a contact opening for contacting a plug contact, the contact part including a spring leg base and spring legs originating from the spring leg base;

a top spring encompassing the contact part of the base spring in a box shape, the top spring being a stamped and bent sheet metal part, the top spring including a bottom wall, two side walls attached to the bottom wall, and a top wall attached to the side walls, the top wall being formed with a first and a second top wall part separated by a production-dictated longitudinal slit;

two mutually opposed walls of the top spring being formed with partially cut-out, inwardly bent tongues resting on the spring legs of the base spring, and one of the walls being formed with a partially cut-out, outwardly bent detent hook extending in a longitudinal direction of the top spring, and the top spring carrying a polarizing element;

at least one of the first and second top wall parts carrying a connecting tab, the connecting tab being formed on a lower portion of the longitudinal slit oriented toward the connecting part of the base spring and on an upper portion of the longitudinal slit oriented toward the contact opening of the base spring, the connecting tab projecting towards a respectively other the top wall part across the longitudinal slit, and being joined to the respectively opposite top wall part.

The tab or tabs are preferably joined to the top wall part by a form-locking and force-locking connection. Form-lock, as used herein, is a connection between two or more parts where the form or shape of the parts themselves prevents separation, while force-lock is a frictional connection where two or more parts are interconnected by means of clamping forces or the like applied externally and causing the parts to engage frictionally.

The above-noted and other objects of the invention are thus satisfied with a contact of the type referred to at the outset, in that on the split top wall of the top spring, a top wall part or both top wall parts is or are embodied in a lower portion of the longitudinal slit oriented toward the connecting part of the base spring and in an upper portion of the longitudinal slit oriented toward the contact opening side of the base spring, with a respective connecting tab pointing at the respectively other top wall part, and that the connecting tabs extend beyond the longitudinal slit and are joined in form-locking and/or force-locking fashion to the respectively opposed top wall part.

In such a contact, because of the connection of the split top wall of the top spring in lower portion, toward the connecting part of the base spring, of the production-dictated longitudinal slit forming the abutment point of the box, and in the upper portion toward the contact opening side, a largely closed box shape of the top spring results, so that the top spring has high stability, and spring deflection that would open the box and impair the contact force reinforcement function of the top spring is prevented.

In accordance with an added feature of the invention, the connecting tab in one portion of the longitudinal slit is disposed on the first top wall part, and in another portion of the longitudinal slit is disposed on the second top wall part.

In accordance with an additional feature of the invention, the connecting tab at the lower portion of the longitudinal slit is bent away from the respective top wall part by an offset and flatly overlaps the respectively other top wall part.

In accordance with another feature of the invention, the connecting tab in the upper portion of the longitudinal slit forms a plate on a face end of the respective top wall part, the plate being bent upwardly and outwardly by 90° from the top wall, and having a partial tab extending past the longitudinal slit, the partial tab being bent by 90° from the top wall and being joined to the respectively other the top wall part.

In accordance with a further feature of the invention, the plate of the connecting tab is disposed centrally relative to the longitudinal slit, and the plate forming the polarizing element for the contact.

In accordance with again an added feature of the invention, the connecting tab at the lower portion has a given width transversely to a plug-in direction of the contact, and the plate has a width transversely to the plug-in direction no less than the given width.

In accordance with again an additional feature of the invention, the connecting tab at the lower portion projects a given height above the top wall, the given height being substantially less than a height defined by the plate.

In accordance with again a further feature of the invention, the detent hook is formed in the bottom wall of the top spring.

In accordance with yet an added feature of the invention, the at least one connecting tab is attached to the respective top wall part by plastic deformation (clinching) or by welding.

In accordance with yet another feature of the invention, each of the side walls of the top spring is formed with a partially cutout and inwardly bent folding tab, the spring leg base having recesses formed therein for receiving the folding tabs therein for securing the top spring to the spring leg base.

In accordance with an additional feature of the invention, the top wall and the bottom wall of the top spring are formed with partially cutout and inwardly bent top spring tongues. The top spring tongues are respectively associated with each spring leg or with each contact lamination formed by longitudinal slitting of the respective spring leg.

Other features which are considered as characteristic for the invention are set forth in the appended claims.

Although the invention is illustrated and described herein as embodied in a bush contact with bottom and top spring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
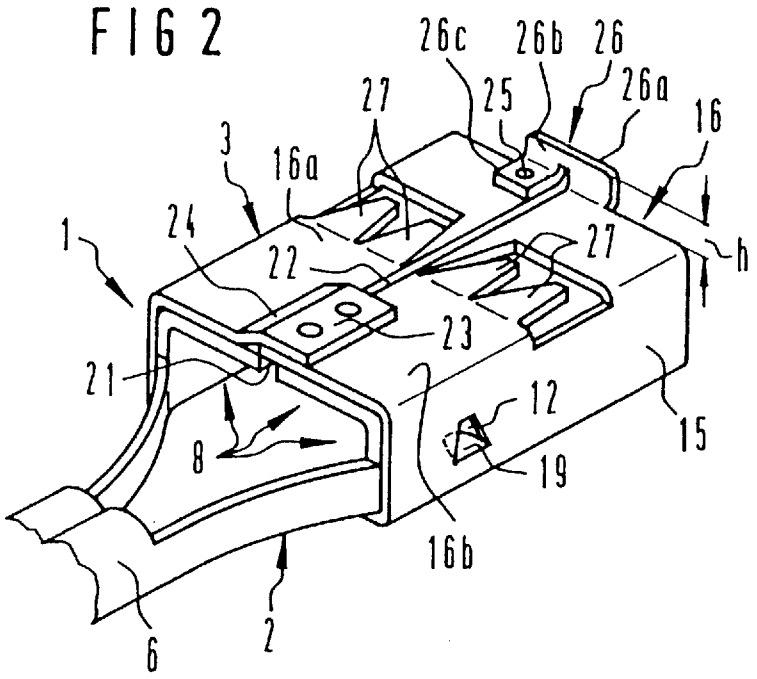
FIG. 2 is a right top perspective view thereof.
Figure 1:
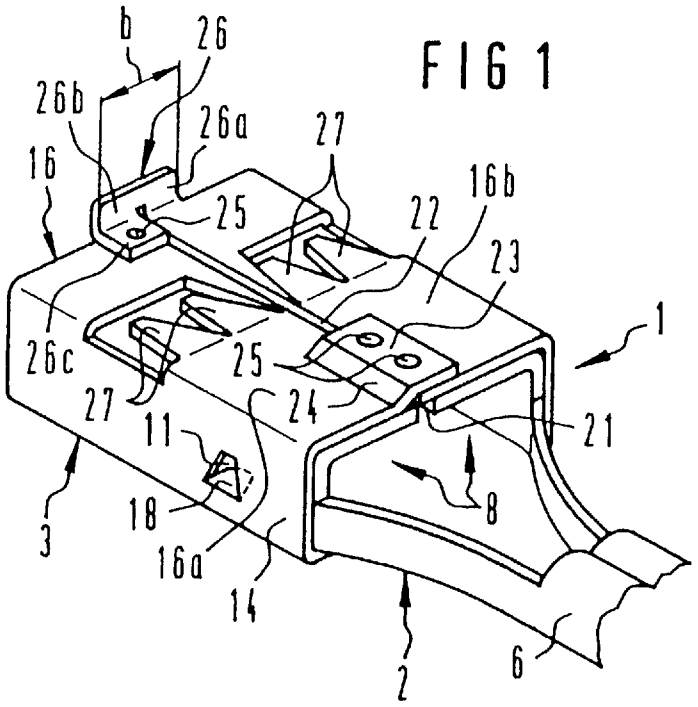
FIG. 1 is a left top perspective view of the contact with a view to the top wall.
Figure 3:
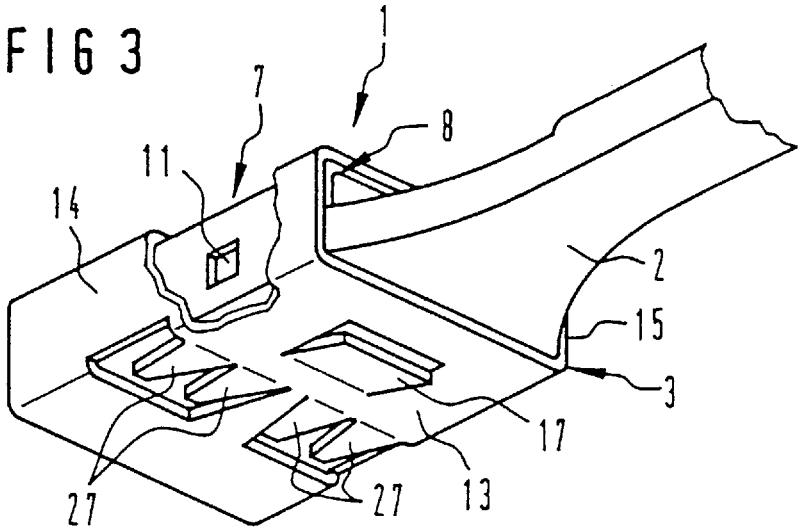
FIG. 3 is a left bottom perspective view thereof, with a view to the bottom wall.

Referring now to the figures of the drawing in detail and first, particularly, to FIGS. 1–3 thereof, there is seen a contact 1 which comprises a base spring 2 and a top spring 3. The contact 1 is plugged into a contact chamber 4 of a contact carrier 5 (FIG. 4), for instance a housing of an electrical plug connection that has contact chambers in one or more rows. The base spring 2 is embodied with a connecting part 6, for instance formed as a crimp connection, for an electric conductor and with a contact part 7, which has a spring leg base 8 of U-shaped or rectangular cross section, for instance, from which base the spring legs 9 and 10 for contacting a plug contact, for instance a knife contact, originate. The spring legs 9 and 10 of the base spring extend for instance from the bottom wall and top wall of a spring leg base 8 of rectangular cross section and may be embodied as normal forked spring arms or as double flat spring contacts, but because of the longitudinal splitting they also have a plurality of contact laminations per spring leg. In the bush contact shown, each spring leg—as will become apparent from the later-described embodiment of the top spring—has four contact laminations.

The top spring 3 is likewise rectangular in cross section, so that in boxlike fashion it surrounds the entire contact part 7 of the base spring 2 with a bottom wall 13, two side walls 14, 15, and a top wall 16. In the lower portion of the bottom wall 13 of the top spring 3, oriented toward the connecting part 6 of the base spring, a detent hook 17 extending longitudinally of the top spring is cut out and bent outward, to serve as a primary securing element for a contact to be introduced into a contact chamber 4 of the contact carrier 5. The top spring 3 is secured to the base spring 2 in a simple manner in that on its short side walls 14, 15, it is provided with small foldover tabs 18, 19, formed by parting cuts and bent inward, these tabs also engaging recesses 11, 12 on the side walls of the spring leg base 8.

Figure 4:
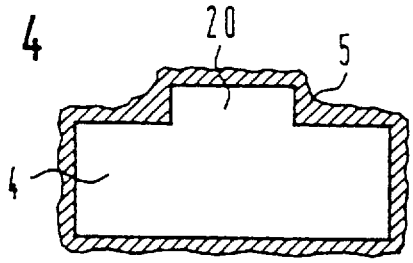
FIG. 4 is a cross section taken through a contact chamber of a contact carrier that receives bush contacts.

The base spring 2 and the top spring 3 are produced from sheet metal from stamped and bent parts and accordingly, for production reasons, have a longitudinal slit. The longitudinal slits 21 and 22 of the base spring 2, or respectively of the top spring 3, are each disposed in the top wall of the two springs; that is, the top spring 3 has a top wall 16, split by the longitudinal slit 22, which here is split centrally and thus has two equal-sized top wall parts 16*a* and 16*b*. To attain a largely closed, stable box shape of the top spring, the two top wall parts 16*a*, 16*b* are joined in the manner described hereinafter. The top wall part 16*a* is embodied in a lower portion, toward the connecting part 6 of the base spring 2, of the longitudinal slit 22 which in this case an approximately rectangular connecting tab 23, which is bent upward by an offset 24 from the top wall part 16*a*, and which extends outward past the longitudinal slit 22 in the direction of the opposite, other top wall part 16*b*, and flatly overlaps the other top wall part 16*b* in one portion. The joining of the connecting tab 23 to the two 16*b* is effected by plastic deformation (clinching), that is, by a plastic cold deformation and pressing into one another of the connection region using a stamping die, or—as shown—by welding, for instance at two welding points 25. Instead of this force-locking connection mode described, a purely form-locking connection of the top wall parts 16*a* and 16*b* via the connecting tabs 23 may for instance also be done. Moreover, the top wall parts 16*a* and 16*b* are also joined together in an upper portion of the longitudinal slit 22, toward the contact opening side of the base spring 2. To that end, in the exemplary embodiment shown, the other top wall part 16*b* is embodied with a connecting tab 26. This connecting tab 26 forms an end plate 26*a*, which is bent upward and outward by an angle of 90° from the top wall part 16*b* and which with a portion 26*b* which extends past the longitudinal slit 22. A partial tab 26*c* is in turn bent by 90° away from this portion 26*b* and extends toward the opposite top wall part 16*a*. This partial tab 26*c* is likewise joined by-welding at a welding point 25 to the top wall part 16*a*. Advantageously, the upward-bent land 26*a* of the connecting tab 26, disposed centrally with respect to the longitudinal slit 22, forms a polarizing element for the contact that points crosswise to the plugging-in direction of the contact, thereby preventing incorrect insertion of the contact into the contact chamber 4 of the contact carrier 5. As the sectional view in FIG. 4 shows, the contact chamber 4 of the contact carrier 5 is embodied with a corresponding polarizing groove 20 for the plate 26*a* of the contact. In order not to prevent the insertion of the contact into the contact chamber 4 of the contact carrier 5, the width of the connecting tab 23 provided in the lower portion is no greater, crosswise to the insertion direction, than the width b of the plate 26*a* in the same direction. Moreover, the height of the connecting tab 23 above the top wall 16 is substantially less than the height h of the plate 26*a*. The dimensions of the connecting tab 23 are thus so that it is located within the contour of the polarizing groove 20.

Figure 5:
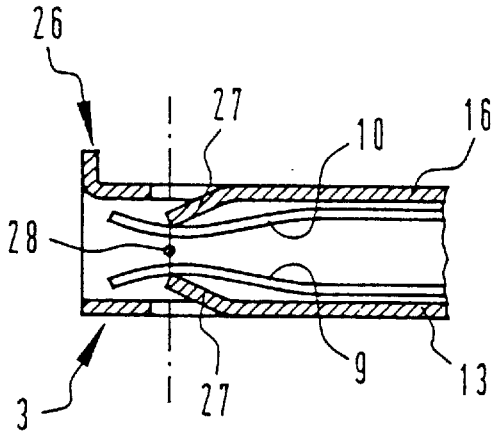
FIG. 5 is a partial sectional view of the contact zone of the contact.

For the sake of completeness, it will also be noted that the top spring 3 is embodied with an inward-bent top spring tongue both on the top wall 16 and the bottom wall 13, for each spring leg 9, 10 of the base spring 2. In accordance with the aforementioned exemplary embodiment of the spring legs 9 and 10, each with four contact laminations formed by longitudinal slitting, the top spring here is provided both on the bottom wall and on the top wall 16 with four inward-bent resilient top spring tongues 27 each, which rest on the contact laminations approximately at the level of the contact zone 28 (FIG. 5).

We claim:

1. A contact, comprising:

a base spring with a connecting part for an electrical conductor and a contact part with a contact opening for contacting a plug contact, said contact part including a spring leg base and spring legs originating from said spring leg base;

a top spring encompassing the contact part of said base spring in a box shape, said top spring being a stamped and bent sheet metal part, said top spring including a bottom wall, two side walls attached to said bottom wall, and a top wall attached to said side walls, said top wall being formed with a first and a second top wall part separated by a production-dictated longitudinal slit;

two mutually opposed walls of said top spring being formed with partially cut-out, inwardly bent tongues resting on said spring legs of said base spring, and one of said walls being formed with a partially cut-out, outwardly bent detent hook extending in a longitudinal direction of said top spring, and said top spring carrying a polarizing element;

at least one of said first and second top wall parts carrying a connecting tab, said connecting tab being formed on a lower portion of said longitudinal slit oriented toward said connecting part of said base spring and on an upper portion of said longitudinal slit oriented toward said contact opening of said base spring, said connecting tab projecting towards a respectively other said top wall part across said longitudinal slit, and being joined to said respectively opposite top wall part, said connecting tab at the lower portion of the longitudinal slit being bent away from the respective said top wall part by an offset and flatly overlapping the respectively other top wall part.

2. The contact according to claim 1, wherein said tab is joined to said top wall part in one of form-locking and force-locking fashion.

3. The contact according to claim 1, wherein said connecting tab in one portion of the longitudinal slit is disposed on said first top wall part, and in another portion of the longitudinal slit is disposed on said second top wall part.

4. The contact according to claim 1, wherein said connecting tab in the upper portion of the longitudinal slit forms a plate on a face end of the respective said top wall part, said plate being bent upwardly and outwardly by 90° from said top wall, and having a partial tab extending past said longitudinal slit, said partial tab being bent by 90° from said top wall and being joined to the respectively other said top wall part.

5. The contact according to claim 1, wherein said detent hook is formed in said bottom wall of said top spring.

6. The contact according to claim 1, wherein said at least one connecting tab is attached to a respective said top wall part by plastic deformation.

7. The contact according to claim 1, wherein said at least one connecting tab is attached to a respective said top wall part by welding.

8. The contact according to claim 1, wherein each of said side walls of said top spring is formed with a partially cutout and inwardly bent folding tab, said spring leg base having recesses formed therein for receiving said folding tabs therein for securing said top spring to said spring leg base.

9. The contact according to claim 1, wherein said top wall and said bottom wall of said top spring are formed with partially cutout and inwardly bent top spring tongues.

10. The contact according to claim 9, wherein said top spring tongues are respectively associated with each said spring leg.

11. The contact according to claim 9, wherein said spring legs each have contact laminations and said top spring tongues are respectively associated with each contact lamination.

12. A contact, comprising:

a base spring with a connecting part for an electrical conductor and a contact part with a contact opening for contacting a plug contact, said contact part including a spring leg base and spring legs originating from said spring leg base;

a top spring encompassing the contact part of said base spring in a box shape, said top spring being a stamped and bent sheet metal part, said top spring including a bottom wall, two side walls attached to said bottom wall, and a top wall attached to said side walls, said top wall being formed with a first and a second top wall part separated by a production-dictated longitudinal slit;

two mutually opposed walls of said top spring being formed with partially cut-out, inwardly bent tongues resting on said spring legs of said base spring, and one of said walls being formed with a partially cut-out, outwardly bent detent hook extending in a longitudinal direction of said top spring, and said top spring carrying a polarizing element;

at least one of said first and second top wall parts carrying a connecting tab, said connecting tab being formed on a lower portion of said longitudinal slit oriented toward said connecting part of said base spring and on an upper portion of said longitudinal slit oriented toward said contact opening of said base spring, said connecting tab projecting towards a respectively other said top wall part across said longitudinal slit, and being joined to said respectively opposite top wall part, said connecting tab in the upper portion of the longitudinal slit forming a plate on a face end of the respective said top wall part, said plate being bent upwardly and outwardly by 90° from said top wall, and having a partial tab extending past said longitudinal slit, said partial tab being bent by 90° from said top wall and being joined to the respectively other said top wall part.

13. The contact according to claim 12, wherein said tab is joined to said top wall part in one of form-locking and force-locking fashion.

14. The contact according to claim 12, wherein said connecting tab in one portion of the longitudinal slit is disposed on said first top wall part, and in another portion of the longitudinal slit is disposed on said second top wall part.

15. The contact according to claim 12, wherein said detent hook is formed in said bottom wall of said top spring.

16. The contact according to claim 12, wherein said at least one connecting tab is attached to a respective said top wall part by plastic deformation.

17. The contact according to claim 12, wherein said at least one connecting tab is attached to a respective said top wall part by welding.

18. The contact according to claim 12, wherein said plate of said connecting tab is disposed centrally relative to said longitudinal slit, and said plate forming said polarizing element for the contact.

19. The contact according to claim 12, wherein said connecting tab at the lower portion has a given width transversely to a plug-in direction of the contact, and said plate has a width transversely to the plug-in direction no less than the given width.

20. The contact according to claim 12, wherein said connecting tab at the lower portion projects a given height above said top wall, said given height being substantially less than a height defined by said plate.

* * * * *